US006119951A

United States Patent [19]

Roffelsen

[11] Patent Number: 6,119,951

[45] Date of Patent: Sep. 19, 2000

[54] EXPANSION CONTROL FOR A CLOSED FLUID CIRCULATION SYSTEM

[75] Inventor: Franciscus Roffelsen, Helmond, Netherlands

[73] Assignee: Spiro Research B.V., Helmond, Netherlands

[21] Appl. No.: 08/973,298

[22] PCT Filed: Jun. 3, 1996

[86] PCT No.: PCT/NL96/00219

§ 371 Date: Oct. 13, 1998

§ 102(e) Date: Oct. 13, 1998

[87] PCT Pub. No.: WO96/38694

PCT Pub. Date: Dec. 5, 1996

[30] Foreign Application Priority Data

Jun. 2, 1995 [NL] Netherlands ..... 1000494

[51] Int. Cl.[7] ..... F24D 3/10

[52] U.S. Cl. ..... 237/66; 137/205; 137/202

[58] Field of Search ..... 237/66; 137/205, 137/202, 197, 199

[56] References Cited

U.S. PATENT DOCUMENTS

| | | | |
|---|---|---|---|
| 3,888,274 | 6/1975 | Weston | 137/202 |
| 4,027,691 | 6/1977 | Roffelsen | 137/202 |
| 4,823,830 | 4/1989 | Bucker | 137/205 |
| 4,951,701 | 8/1990 | Boehmer | 137/199 |
| 5,069,243 | 12/1991 | Foreman | 137/205 |
| 5,456,409 | 10/1995 | Roffelsen | 237/66 |

*Primary Examiner*—Harold Joyce
*Assistant Examiner*—Derek S. Boles
*Attorney, Agent, or Firm*—Varnum, Riddering, Schmidt & Howlett LLP

[57] ABSTRACT

A method for expansion control in a closed fluid circulation system with varying temperature, in which system air is drawn from the circulating fluid through the formation of an air head wherein air to be withdrawn is collected and from which air can be blown off, controlled by a valve, to the environment or a receiving space, while further off, measures are taken for taking up, when the temperature varies, an attendant expansion and shrinking of the fluid within the closed system, and measures for enabling adding fluid to the system, which fluid is withdrawn from an external stock of fluid under pressure, and the air head volume is measured and when a predetermined value is exceeded, a fluid valve is opened through which fluid is introduced into the air head until the volume of the air head is substantially equal to the predetermined value and the fluid valve is closed.

13 Claims, 2 Drawing Sheets

EXPANSION CONTROL FOR A CLOSED FLUID CIRCULATION SYSTEM

Figure 1:
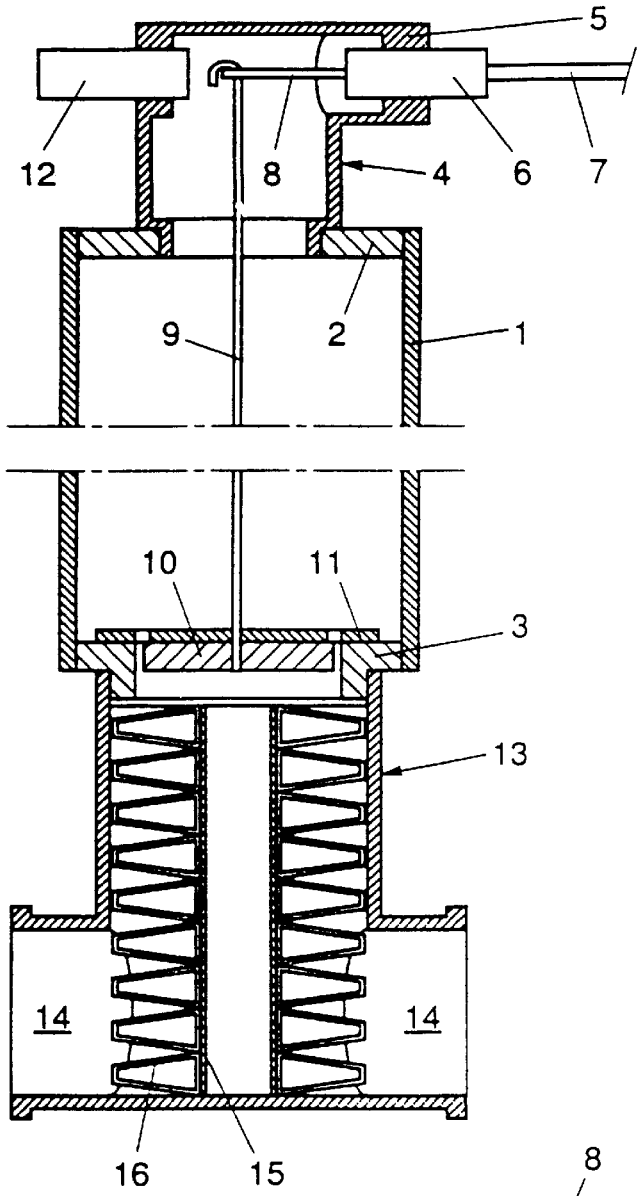

The invention relates to a method for expansion control in a closed fluid circulation system with varying temperature, in which system air or another gas present is withdrawn from the circulating fluid through the formation of an air or gas head wherein air or gas to be withdrawn is collected and from which air or gas can be blown off, controlled by a valve, to the environment or a receiving space, whilst, further, measures are taken for taking up, when the temperature varies, an attendant expansion and shrinking of the fluid within the closed system, and measures for enabling adding fluid to the system, which fluid is withdrawn from an external stock of fluid under pressure. The invention also relates to a closed fluid circulation system for carrying out a method as referred to hereinabove.

Such a method is generally known from central heating engineering, and the measures for taking up the expansion and shrinking of the fluid at a varying temperature typically comprise an expansion tank subdivided by a diaphragm into two separate spaces, one space being in open communication with the network of pipes and the other space containing a gas capable of taking up variations in the volume of the fluid caused by a varying fluid temperature, through compression or expansion by means of a displacement of the diaphragm. For venting automatically, a float-controlled valve can be used, such as is for instance known from U.S. Pat. No. 4,027,691.

In such a fluid circulation system, fluid leakage will virtually always occur, although usually only to a very small extent, and often it cannot be established where that leakage occurs, because a small leaking amount of fluid, in the case of central heating systems virtually always water, evaporates almost directly. In this manner, the compensation capacity of the expansion tank may become exhausted and the pressure in the closed system may drop below a minimum pressure, resulting in failure of the heating system with all its unpleasant incidental circumstances, such as a cold living environment or even the freezing of conduits. The leaking of fluid may also entail the ingress of air, which air, in the presence of a float-controlled vent valve according to U.S. Pat. No. 4,027,691 is automatically discharged again, which also influences the pressure drop in the closed system. If the system is to remain operational, the pressure should be checked regularly and, if necessary, fluid should be replenished, which is usually a laborious and wet affair.

The object of the invention is to provide a method with which an expansion control in the closed fluid circulation system can be obtained such that, in fact, it continues functioning automatically and without regular supervision.

A further object of the invention is to realize the expansion control with means which are as simple and cheap as possible.

In accordance with the invention, an automatic, self-regulating expansion control with a method of the type described in the opening paragraph is realized in that the volume of the air or gas head is monitored and, when a predetermined value of that volume is exceeded, a fluid valve is opened through which fluid is introduced into the air or gas head until it is established that the volume of the air head is substantially equal to the predetermined value again and the fluid valve is closed again. Through these measures, fluid replenishment will automatically be provided for as soon as the fluid volume in the closed system drops below a predetermined minimum, so that system failure caused by too low a pressure is prevented.

Because the air or gas head is in direct communication with the fluid circulating in the circulation system, the drop of the fluid level below the predetermined minimum will virtually always occur when the temperature and, accordingly, the pressure of the circulating fluid is lowest. In that case, the pressure difference between the air or gas head and the make-up fluid is greatest, which has the further advantage that through the supply of the replenished fluid into the air or gas head, this fluid is already directly degassed largely, because of that pressure drop. For instance, it is known that with water of 10° C., in the case of a pressure drop from 5 bar abs. to 1.5 bar abs., the possible air absorption drops from 115 liter to 35 liter per $m^3$, hence a decrease of 70%. The gas thus withdrawn from the make-up fluid is directly collected in the air or gas head and hence does not end up in the circulation system. If the pressure in the system exceeds a predetermined value when the temperature of the circulation fluid rises again, then the valve provided for that purpose will open and that gas, together with gas withdrawn from the circulating fluid, will, as is known, be blown off to the environment.

Because the air or gas head is in direct communication with the fluid circulation system and hence the fluid level in that air or gas head drops, for instance because of leakage, fluid replenishment is possible in a particularly convenient, simple and reliable manner in accordance with a further embodiment of the invention, if the volume of the air or gas head is monitored by means of a float connected to the fluid supply valve in such a manner that when the float drops below a predetermined level, the fluid valve is opened and when the level rises as a result of the supply of fluid, the fluid supply valve is closed when the predetermined level is reached, whilst, further, the connection between float and valve is such that at any fluid level above this predetermined level, the float does not influence the closed position of the fluid valve. In this manner, an effective and extremely reliable manner of replenishing is obtained with particularly simple means. The float has the further advantage that it reduces the free water surface area and hence lowers the chance of gas absorption in the air or gas head, while it is observed that this chance was small anyhow because the air or gas head, although directly connected to the circulation system, is yet located outside the circulation circuit proper.

It has been observed that the fluid level in the air or gas head varies depending on the temperature of the circulating fluid, and that at that fluid level, the gas absorption is virtually nil. These conditions can be utilized in a particularly advantageous manner if, in accordance with a further preferred embodiment of the invention, the air or gas head is given such ample dimensions that, during normal operation of the fluid circulation system, it has a greater volume than the maximum expansion volume to be calculated from the total fluid content of the fluid circulation system and, during normal operation, the maximum temperature difference to which the fluid is subject. By taking these measures, the building in of a generally known expansion tank comprising a diaphragm can be omitted, because this function is now incorporated into the air or gas head. Thus, with relatively extremely simple means an integrated manner of continuous, automatic venting, replenishing and expansion-controlling is obtained.

In accordance with a further embodiment of the invention, for blowing off from the air or gas head to the environment, it is provided that air or gas withdrawn from the fluid is blown off via an excess pressure valve arranged in the air or gas head, with which valve the pressure which can maximally prevail in the fluid circulation system is thus determined. In this manner, an integrated protection against excess pressure is further provided.

If, in accordance with a further embodiment of the invention, the air or gas head is formed in a bypass channel, it can in a simple manner be temporarily separated from the circulation system for maintenance purposes, for instance cleaning. If it is provided that the circulation of the fluid is provided by a pump, with the inlet and the outlet of the bypass channel being disposed on either side of the pump, then, on the one hand, an optimally quiet fluid level can be obtained in the air or gas head and, on the other hand, it is provided that at the location where most microbubbles are formed, viz. the circulation pump, those microbubbles are caught as quickly as possible in order to arrive in this manner at an optimally vented system. For the same reason, it is preferred that the air or gas head be formed in at least the direct proximity of the location where, during normal operation, the temperature of the circulating fluid reaches the highest value.

The invention also relates to a closed fluid circulation system comprising a heating apparatus and, connecting thereto, a network of pipes, incorporating an expansion device for compensating for the fluid expanding and shrinking in the closed system, and an automatic, valve-operated venting device having a stub of which one end is in open communication with a conduit of the network and the other end is shut off from the environment, whilst a vent valve is arranged in that shut-off end and a float is accommodated in the stub for movement in longitudinal direction. Such a fluid circulation system with expansion tank is generally known in central heating engineering and referred to in U.S. Pat. No. 4,027,691, which shows in more detail an automatic, valve-operated venting device. In order to realize in such a system a combined venting and replenishment according to the invention, it is provided that a fluid supply valve opens into the shut-off end, which valve comprises an operating member connected to the float so that when a predetermined distance between float and operating member is exceeded, the latter opens the valve and when a distance between float and operating member is equal to or less than the predetermined distance, the operating member maintains the valve in its closed position. In this manner, the venting device is conveniently utilized for obtaining an automatic level-controlled or volume-controlled replenishment.

If the predetermined distance between the float and the operating member has a value such that the volume of the stub between the float and the operating member in the situation of the predetermined distance between the two is greater than the maximum expansion volume to be calculated from the total fluid content of the fluid circulation system and, during normal operation, the maximum temperature difference to which the fluid is subject, then the combined venting and replenishment system also provides for the expansion control, so that the known diaphragm expansion tank can be omitted, which is not only cost-saving on account of this omission, but also because the known expansion tanks are fairly susceptible to failure and have a relatively short life compared with the life of the overall system. This last can in particular be attributed to tearing of the diaphragm, whereupon, normally, the entire expansion tank is replaced with all costs and operations involved, including the draining, at least partly, of the system. In the construction presently proposed, such a diaphragm is no longer present, nor is it replaced by an element which is equally susceptible to failure, as a result of which the life of the apparatus regulating, inter alia, the expansion control, increases considerably.

If relatively voluminous fluid circulation systems are involved, i.e. circulation systems containing relatively much fluid, then the expansion volume can be relatively great. In that case, in accordance with a further embodiment of the invention, it is preferred that next to the stub, at least one further stub is arranged which, via coupling parts, is in open communication with the first-mentioned stub, both at a level below the float and at a level adjacent the closed end, whilst the predetermined distance between the float and the operating member has a value such that the total volume of all stubs between the float and the operating member in the situation of the predetermined distance between the two is greater than the maximum expansion volume to be calculated from the total fluid content of the fluid circulation system and, during normal operation, the maximum temperature difference to which the fluid is subject. Through these measures, a great expansion volume can be realized without this resulting in voluminous tanks or containers. Moreover, with those measures, it is in fact sufficient to use a standard device for the combined venting, replenishment and expansion control, which, by coupling thereto a suitable number of stubs, can be adjusted to the expansion volume required for a particular system.

In the automatic venting device known from U.S. Pat. No. 4,027,691, the vent valve is controlled by the float. In the closed fluid circulation system according to the invention, that float is used for operating a make-up valve. Although it is possible to use that float also for opening the vent valve, in accordance with a further embodiment of the invention, it is preferred that in or adjacent the shut-off end of the stub a vent valve is arranged, opening when a predetermined value is exceeded. In that case, replenishment takes place, if necessary, by means of the float-operated valve at a temperature of the circulating fluid which is typically relative low, while venting takes place at a relatively high temperature, with the air or gas head being compressed by the expanding fluid. Moreover, that vent valve may also be provided with a protection against excess pressure.

Figure 4:
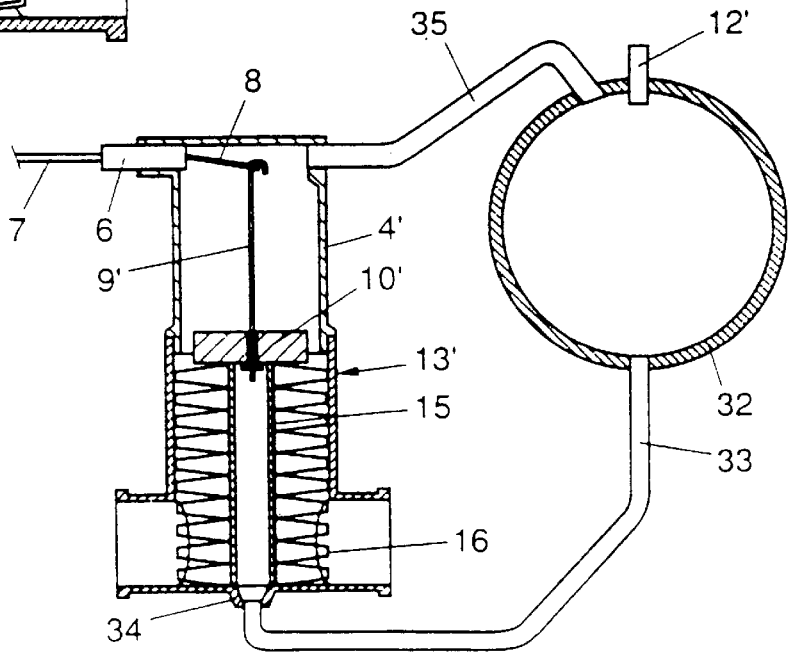
Figure 2:
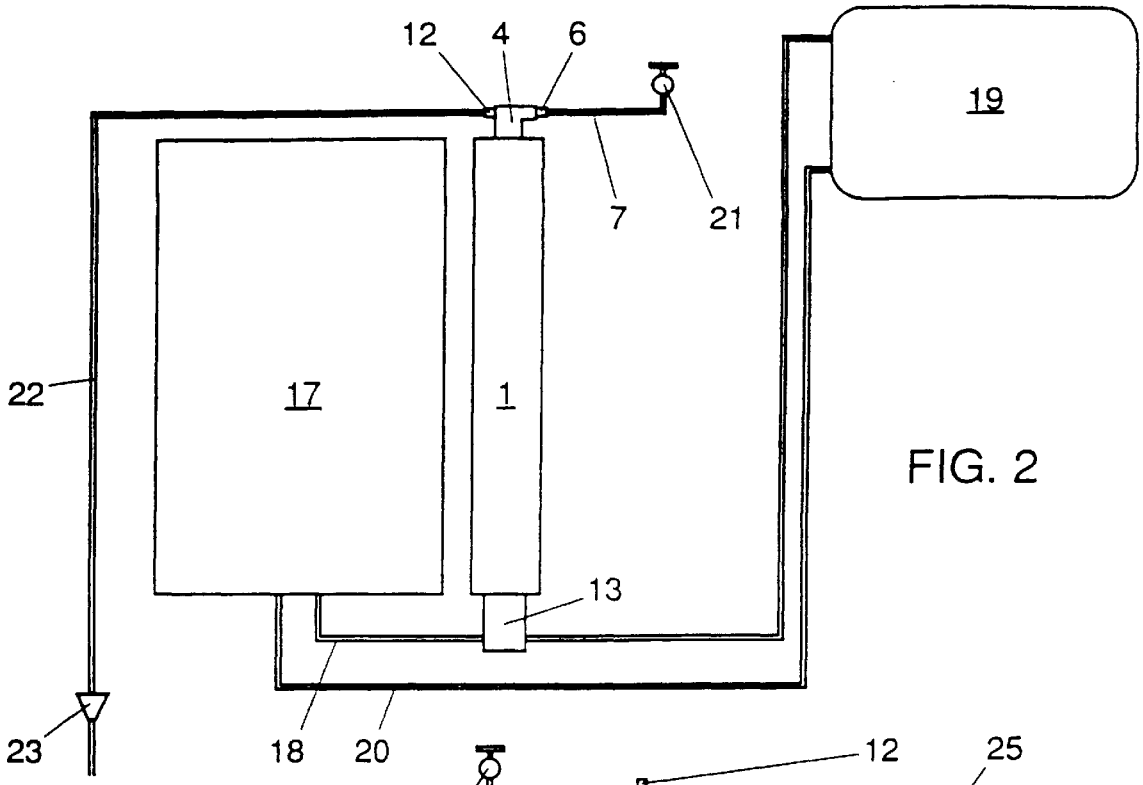
Figure 3:
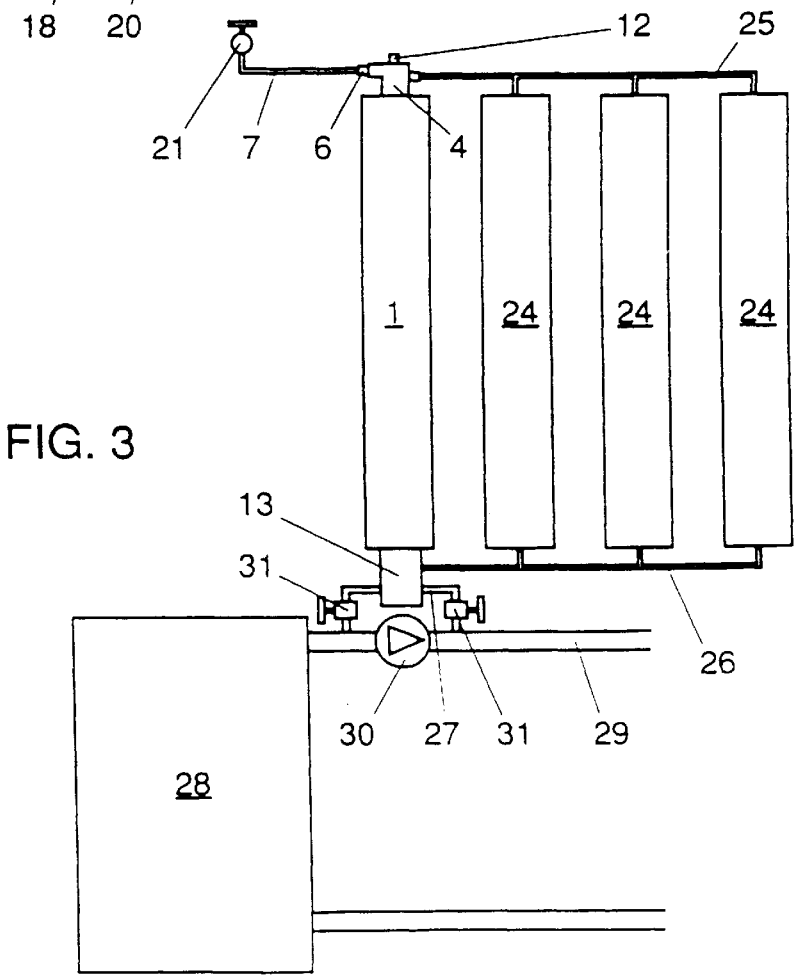

Hereinafter, a number of possible embodiments of the method and the system according to the invention will be further discussed with reference to the exemplary embodiments shown in the accompanying drawings, wherein:

FIG. 1 shows, in cross section, a first structural variant of the system according to the invention;

FIG. 2 schematically shows a first embodiment of a heating installation having a built-in system according to FIG. 1;

FIG. 3 schematically shows a second embodiment of a heating installation having a built-in system according to FIG. 1;

FIG. 4 shows a second structural variant of the system according to the invention.

The system shown in FIG. 1 comprises a cylindrical housing 1 having a top cover 2 and a bottom cover 3, the content of the housing 1 being greater than the total fluid expansion to be expected in a closed circulation system for which the system is intended.

Mounted in the top cover 2 is a cylindrical head 4, provided with a stub 5 including a valve 6 which is at one end connected to a water conduit 7 and at the other end carries an operating member 8, which opens the valve 6 by pivoting downwards. Suspended from the end of the operating member 8 remote from the valve 6 is a float needle 9, carrying a float 10 located under a plate 11 provided with openings, through which the float needle 9 can slide freely. The head 4 further comprises a vent valve 12 which also serves as protection against excess pressure.

Attached to the bottom cover 3 is a T-shaped pipe piece 13 whose stubs 14, in alignment, are incorporated into a closed fluid circulation system, not further shown. In the transverse part of the T-shaped pipe piece 13, a tube 15 extends centrally into the passage between the stubs 14, on which tube 15 a wire 16, wound so as to be double spiral-shaped, is provided. This wire 16 catches microbubbles from the fluid flowing past and guides them upwards to the housing FIG. 2 shows a heating boiler 17 to be hung on a wall, from which boiler heated water is conveyed, via a conduit 18, to a heating body 19. After the heat is delivered, the water flows back to the boiler 17 via the conduit 20. The T-shaped piece of pipe 13 is incorporated into the conduit 18. As mentioned, as far as its content is concerned, the housing 1 is adjusted to the maximum volume difference to be expected of the circulating water, i.e. the volume of the water at its maximum temperature minus the volume of the water at its minimum temperature, the maximum and minimum temperatures having operationally determined values. By means of the valve 6 and the conduit 7, the head 4 on the housing 1 is connected to a tap 21. Further, a conduit 22 is connected to the vent valve 12 in the head 4, which conduit incorporates a moisture detector 23 and which leads to a drain, such as a sewer, not further shown.

In the heating apparatus according to FIG. 2, the system of FIG. 1 provides for taking up the expansion of the circulating fluid, the automatic venting and the automatic replenishment in the event of leakage.

Under normal operating conditions, the fluid level will, at the lowest operating temperature, be approximately at the level of the float 9 in FIG. 1. If the temperature rises, the fluid expands and the fluid level in the housing 1 will rise, while the plate 11 remains floating on the fluid, so that the free fluid surface area is relatively small. Accordingly, the gas above the fluid level is compressed. If such an amount of air is caught by the tube 15 with wire 16 and passed to the housing 1, that during this compression the pressure reaches a certain value, then the vent valve 12 opens and gas is blown off, which is discharged via the conduit 22.

If the temperature of the circulating fluid drops and fluid has escaped from the heating installation because of leakage, then the fluid level will drop below the plate 11. When the fluid level drops further, the float 10 drops as well and opens valve 6, causing new fluid to be replenished via the conduit 7. At that moment, the temperature of the fluid and, accordingly, the pressure in the housing 1 is low. Hence, the replenished fluid undergoes a pressure drop and is thus largely degassed directly. That gas remains in the top part of the housing 1 and the head 4 and will in due time be blown off via the valve 12.

In FIG. 3, the system of FIG. 1 is adjusted for a relatively voluminous heating installation. For that purpose, a number of further housings 24 are present, the top ends of which are in open communication, via a conduit system 25, with the head 4 and the bottom ends of which are in open communication, via a conduit system 26, with the T-shaped pipe piece 13. If the content of each of the further housings 24 is assumed to be equal to that of the housing 1, the expansion capacity is thus quadrupled. In this embodiment, the T-shaped pipe piece 13 is connected via a bypass channel 27 to a conduit 29 coming from a boiler 28, and the bypass channel 27 bridges a circulation pump 30 and is separable from the circulation system by means of valves 31, for instance for servicing purposes.

FIG. 4 shows a variant of the system of FIG. 1. In fact, the housing 1 is left out and a head 4' is directly connected to the T-shaped pipe piece 13', which again contains a tube 15 having wire 16. Via float needle 9' and operating member 8, a float 10' provides for the opening of the valve 6, if so desired, to enable replenishment of water coming from the conduit 7. Because of the relatively small dimensions of the head 4', there is insufficient expansion volume in that head. To provide for sufficient expansion volume, a cylindrical housing 32 is present whose center line extends horizontally and whose bottom side extends approximately at the level of the float 10' in its lowest position. The content of the housing 32 is again adjusted to the desired expansion volume. Via a conduit 33, that bottom side of the housing 32 is in open communication with the bottom side of the T-shaped pipe piece 13', which, for that purpose, comprises a connection 34 at the location of the tube 15. Further, via a conduit 35, the top side of the housing 32 is in open communication with the top side of the head 4'. Finally, a vent valve 12' is further provided in the top side of the housing 32, for blowing off a gas excess in the heating installation.

The operation of this modified embodiment is in fact identical to the operation discussed hereinabove with reference to the system of FIG. 1, so that it is believed that a further discussion can be omitted.

It is a matter of course that within the framework of the invention as laid down in the appended claims still many modifications and variants are possible.

What is claimed is:

1. A method for expansion control of fluid in a closed fluid circulation system with variations in temperature, said method comprising the steps of:

withdrawing gas from said fluid by formation of a gas head, said gas head having a variable volume;

providing a first valve for releasing gas from said gas head to a receiving space;

providing a stock of fluid under pressure and connected to said system via a second valve;

monitoring said volume of said gas head;

opening said second valve for transferring fluid into said gas head when said volume exceeds a predetermined value; and closing said second valve when said volume is substantially equal to said predetermined value.

2. The method in accordance with claim 1 wherein the step of monitoring said volume comprises providing a float connected to said second valve for opening said second valve when said float falls below a predetermined level and closing said valve when said predetermined level is reached.

3. The method in accordance with claim 1 wherein said gas head is controlled such that said gas head has a volume greater than a maximum value calculated from a total fluid content of said circulation system and a maximum anticipated difference of a high temperature and a low temperature of said fluid.

4. The method in accordance with claim 1 wherein said gas withdrawn from said fluid is blown off via an excess pressure valve, whereby a maximum pressure in said circulation system is determined.

5. The method in accordance with claim 1 wherein said gas head is formed in a by-pass channel.

6. The method in accordance with claim 5 wherein said fluid is circulated by a pump having opposite sides, said by-pass channel being disposed between said opposite sides of said pump.

7. The method in accordance with claim 1 wherein said circulating fluid reaches a temperature having a high value at a specified location of said system and wherein said gas head is formed in close proximity to said specified location.

8. A closed fluid circulation system comprising a network of pipes for containing a liquid and comprising:

heating apparatus for heating said liquid;

an expansion device for compensating for fluid expanding and contracting in said closed system;

a conduit;

a venting device having a stub, said stub having an open end in open communication with said conduit and having a closed end, opposite said open end;

a vent valve in said closed end;

a float disposed in said stub;

an operating member in said stub operatively connected to said float; and a fluid supply valve in said closed end of said conduit operative to open said valve when said float is spaced apart from said operating member by a distance greater than a predetermined distance.

9. The closed fluid circulation system in accordance with claim 8 wherein the predetermined distance between said float and said operating member has a predetermined value, said value being selected such that a volume of the stub between said float and said operating member is greater than a maximum expansion volume defined by a total fluid content of said fluid circulation system and a predefined maximum temperature difference.

10. The fluid circulation system in accordance with claim 9 and further comprising a further stub disposed adjacent to said at least one stub, said further stub being an open communication with said at least one stub wherein said predetermined distance between said float and said operating member has a value such that a total volume of said stubs in a spatial area between said float and said operating member is greater than a maximum expansion volume at a prescribed maximum temperature difference of said fluid at a predefined high temperature and a predefined low temperature.

11. In accordance with claim 8, and further comprising a vent valve disposed adjacent said shut-off end of said stub and operative for opening when a predetermined value of said pressure is exceeded.

12. The closed fluid circulation system in accordance with claim 8, and further comprising a by-pass channel for said network of pipes and wherein said open end of said stub is connected to said by-pass channel.

13. The system in accordance with claim 12 and further comprising a circulation pump, said pump being bridged by said by-pass channel.

* * * * *